US008083616B2

(12) United States Patent
Cameron

(10) Patent No.: US 8,083,616 B2
(45) Date of Patent: Dec. 27, 2011

(54) GOLF BALL MARKER

(75) Inventor: Don T. Cameron, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 12/134,399

(22) Filed: Jun. 6, 2008

(65) Prior Publication Data

US 2009/0305817 A1 Dec. 10, 2009

(51) Int. Cl.
*A63B 57/00* (2006.01)

(52) U.S. Cl. ..... 473/406

(58) Field of Classification Search ..... 473/286, 473/406, 257, 220; D21/793, 794
See application file for complete search history.

(56) References Cited

U.S. PATENT DOCUMENTS

| | | | | | |
|---|---|---|---|---|---|
| 1,735,736 | A | * | 11/1929 | Davidson | 473/406 |
| 2,107,944 | A | * | 2/1938 | Howard | 473/406 |
| 3,041,071 | A | | 6/1962 | Fialon | |
| 4,521,018 | A | * | 6/1985 | Cotchonis | 473/406 |
| 5,240,254 | A | * | 8/1993 | Adlam | 473/257 |
| 5,356,133 | A | * | 10/1994 | Bellagamba | 473/406 |
| 5,401,019 | A | * | 3/1995 | Wissman et al. | 473/286 |
| 5,437,446 | A | * | 8/1995 | Youngkin | 473/257 |
| 5,449,176 | A | * | 9/1995 | Schwab, Jr. | 473/268 |
| 5,476,258 | A | | 12/1995 | Frisone | |
| D405,858 | S | * | 2/1999 | Wolff | D21/759 |
| 6,074,311 | A | * | 6/2000 | Froud et al. | 473/406 |
| D428,954 | S | * | 8/2000 | Tate | D21/793 |
| 6,227,983 | B1 | * | 5/2001 | Yang | 473/220 |
| 6,394,916 | B1 | * | 5/2002 | Doucettperry | 473/406 |
| 6,739,980 | B2 | | 5/2004 | Scott et al. | |
| D520,588 | S | * | 5/2006 | Morgan | D21/794 |
| 7,083,535 | B1 | * | 8/2006 | Robinson | 473/408 |
| D583,893 | S | * | 12/2008 | Ruff | D21/794 |
| D588,226 | S | * | 3/2009 | Brown | D21/794 |
| 2005/0026727 | A1 | | 2/2005 | Barouh | |
| 2005/0070380 | A1 | * | 3/2005 | Miller et al. | 473/406 |
| 2009/0305818 | A1 | * | 12/2009 | Cameron | 473/406 |

OTHER PUBLICATIONS

"Putting Tools" from Golf by Colors, www.puttingtool.com/live/, 2 pages, Apr. 30, 2009.
"Using Your Ball Marker," www.vbsa.org.au/Referees, 2 pages, Jun. 3, 2008.
"Tools of the Trade," www.prosnookerref.co.uk/tools_of_the_trade.php, 2 pages, 2006.
"Image Gallery," www.prosnookerref.co.uk/images.php, 3 pages, 2006.

* cited by examiner

*Primary Examiner* — Steven Wong
(74) *Attorney, Agent, or Firm* — Michael J. Mancuso

(57) ABSTRACT

A golf ball marker that includes a body having a geometric shape and an arcuate ball location reference for easily positioning a golf ball. The body may also include alignment indicia for aligning the golf ball with an intended ball path.

10 Claims, 2 Drawing Sheets

GOLF BALL MARKER

FIELD OF THE INVENTION

This invention generally relates to golf accessories, and more specifically to a golf ball marker.

BACKGROUND OF THE INVENTION

During a round of golf, players awaiting their turn on a green and players wishing to remove their ball from the surface of the green, such as for cleaning and/or alignment, place a ball marker adjacent their ball so that the ball may be returned to that position. Oftentimes players utilize common small objects, such as coins, as ball markers.

Some ball markers incorporate features that aid a golfer in the alignment of their ball and putting stroke. Generally those markers include a disk coupled to an end of an elongate projection and one or more sight lines, or arrows, oriented in a single direction. During use, the projection is inserted into the putting surface and the disk is rotated to indicate the direction of a desired ball path. Because those markers only indicate a single direction of alignment, players often perform multiple iterations of orienting the alignment device and stepping back to view the orientation. Alternatively, players perform multiple steps of placing the ball and confirming the alignment, such as with an alignment marking included on the ball. In either case, the iterative process slows the speed of play.

It is desired to provide a ball marker that provides a more efficient alignment mechanism.

SUMMARY OF THE INVENTION

The invention is directed to a golf ball marker that allows a user to align and re-align intended ball paths without requiring movement of the marker regardless of the presence of a golf ball. Additionally, the present invention allows the user to align an alignment mark of a golf ball with at least one of a plurality of alignment marks on the ball marker by rotating the golf ball about the center of the golf ball while the ball marker remains stationary and the golf ball remains properly located. Several embodiments of the present invention are described below.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

The present invention is directed to a golf ball marker. Several embodiments of the present invention are described below.

Figure 1:
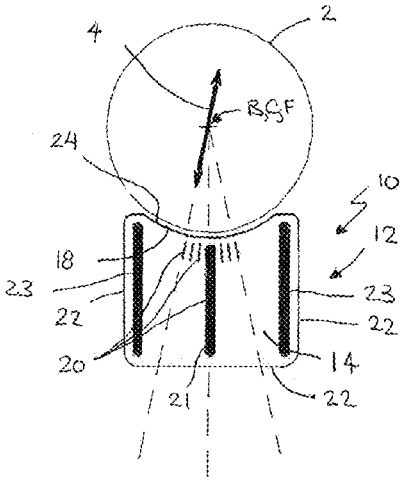
FIG. 1 is a top view of a golf ball marker of the present invention.
Figure 2:
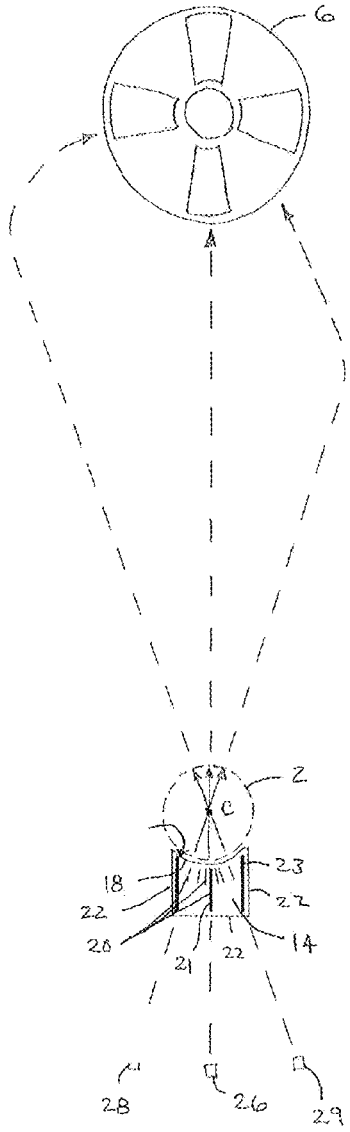
FIG. 2 is a schematic view illustrating use of the marker of FIG. 1.

An embodiment of a golf ball marker 10 includes a body 12 having a geometric perimeter shape and including a top surface 14, a bottom surface 16 (shown in FIG. 7), an arcuate ball location reference 18 and a plurality of alignment indicia 20, as shown in FIGS. 1 and 2. Body 12 has a generally square perimeter shape and a thickness defined by a plurality of side walls 22 extending between top surface 14 and bottom surface 16. Top surface 14 and bottom surface 16 are generally planar surfaces. Top surface 14 includes alignment indicia 20 and bottom surface 16 provides a stable ground contacting platform so that marker 10 is stable when placed on a putting surface. The thickness of body 12 is preferably in a range of 0.050 inch to 0.250 inch, and more preferably approximately 0.125 inch. The length of each of the sides of the generally square body 12 is in a range of 0.75 inch to 1.50 inches, and preferably approximately 1.00 inch.

In the present embodiment, body 12 includes an arcuate side wall so that marker 10 includes an arcuate side surface 24. Arcuate side surface 24 intersects top surface 14 forming an arcuate edge that is an arcuate ball location reference 18. Arcuate side surface 24 is a cylindrical surface that is approximately perpendicular to top surface 14 and the radius of curvature is approximately 0.850 inch. The radius of curvature of ball location reference 18 is preferably in a range of 0.725 inch to 0.975 inch.

During a round, a user places marker 10 adjacent golf ball 2 so that, when viewed from above, the arcuate ball location reference 18 approximately matches the curvature of the outer surface of golf ball 2. When marker 10 is placed in that position, the center of curvature C of ball location reference 18 is approximately aligned vertically with the center B of ball 2. As a result, ball location reference 18 allows a golfer to easily and accurately replace golf ball 2 to its original location simply by locating ball 2 relative to ball location reference 18.

Alignment indicia 20 are located on top surface 14. In the present embodiment, alignment indicia 20 are elongate, linear markings, a plurality of which are identical, that are perpendicular to ball location reference 18 so that they radiate from a focal point F that is coincident with the center of curvature C of ball location reference 18. Because of that orientation, when ball 2 is located relative to ball location reference 18, as described above, focal point F is also approximately vertically aligned with the center B of golf ball 2. Preferably, alignment indicia are rotated relative to each other about the focal point F by a predetermined constant angle that may be between 1° and 10°. For example, each of the alignment indicia may be rotated relative to the next adjacent indicium, or indicia, by a constant angle, such as 5°.

Alignment indicia 20 may have various lengths and widths. For example, marker 10 includes a central indicium 21 that has a length that is approximately equal to the length of the center portion of body 12 and optional parallel indicia 23 that are parallel to central indicium 21 and spaced laterally therefrom, adjacent the side surfaces of body 12. Alternatively, the alignment indicia may be dots or symbols and each of the indicia is preferably spaced perpendicularly away from ball location reference 18 by a constant amount. Additionally, the alignment indicia may be painted and/or machined into the top surface of the marker.

After a user places marker 10 and removes ball 2, marker 10 provides a clear reference to view different ball paths from a distance. For example, and as illustrated schematically in FIG. 2, the user initially places the marker so that a central indicium 21 is aligned with an initial orientation, such as towards hole 6. Then, the user removes their ball from the putting surface and views alternative ball paths from alternative positions 26, 28, 29 that correspond to a plurality of ball paths extending through alignment indicia 20. Because of the location of focal point F, those paths also generally pass through the proper ball location. The user may then easily determine which indicia corresponds to a desired ball path for the contour of the putting surface.

When it is the user's turn to putt, the user easily replaces the ball 2 in the original location and aligns an alignment mark 4 included on ball 2 with an indicium 20 on marker 10 corresponding to the desired ball path. Finally, the marker may be removed and the ball remains in the proper position with the desired ball path, and putting stroke, indicated by alignment mark 4. Using the marker of the present invention, a golfer may easily determine a desired ball path without altering the position of the marker and without performing multiple steps of placing and confirming the alignment of a ball. Additionally, the player may determine a desired path from a distant location that does not interfere with other players even while those other players are putting.

Figure 3:
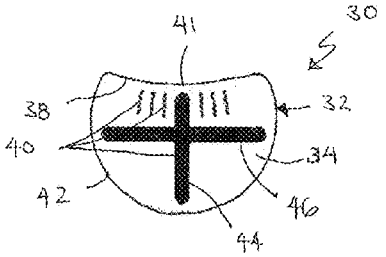
FIG. 3 is a top view of another embodiment of the ball marker of the present invention.

Referring to FIG. 3, another embodiment of a golf ball marker 30. Marker 30 includes body 32 having a generally curved, crescent perimeter shape and including a top surface 34, a bottom surface, an arcuate ball location reference 38 and a plurality of alignment indicia 40. Body 32 has a thickness defined by a concave arcuate side wall 41 and a convex arcuate side wall 42 extending between top surface 34 and the bottom surface. Similar to the previously described embodiment, concave arcuate side wall 41 is generally perpendicular to and intersects top surface 34 to form an arcuate edge that is ball location reference 38, which has a radius of curvature in a range of 0.725 inch to 0.975 inch.

Alignment indicia 40 are elongate markings located on top surface 34 that are perpendicular to ball location reference 38 so that they radiate from a focal point F that is coincident with the center of curvature C of ball location reference 38. Indicia 40 include a central elongate indicium 44 and a lateral indicium 46 that intersects central indicium 44 so that indicia 44, 46 combine to form a cross.

It should be appreciated that the body of the ball marker may have any geometric perimeter shape. For example, the body may have a polygonal perimeter, such as a square, triangle or rectangle; a curved perimeter, such as a crescent; or a combined curved and polygonal perimeter.

Figure 4:
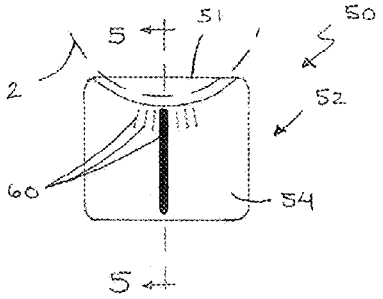
FIG. 4 is a top view of the ball marker of the present invention.

Alternate constructions of the arcuate ball location reference will be described with reference to FIGS. 4 and 5A-5C. Although the various embodiments have different constructions, shown in FIGS. 5A-5C, they share a common top view appearance, as shown in FIG. 4. Generally, marker 50 includes body 52 having a geometric shape and including a top surface 54, a bottom surface, a planar side wall 51, an arcuate ball location reference and a plurality of alignment indicia 60.

Figure 5A:
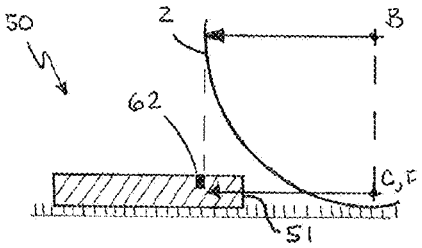
FIGS. 5A-5C are cross-sectional views of embodiments of ball markers.

In the embodiment of FIG. 5A, an arcuate ball location reference 62 is an arcuate marking provided on the top surface. For example, the marking may be a painted and/or engraved curve or the marking may be a machined groove extending into the body from the top surface, which may be optionally paint filled.

Figure 5B:
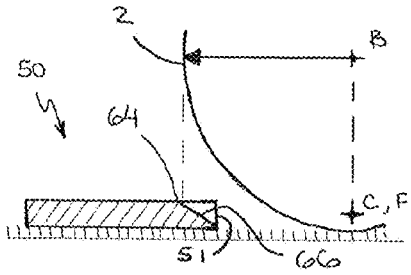

In another embodiment, shown in FIG. 5B, an arcuate ball location reference 64 is an arcuate edge formed at an intersection between a tapered arcuate surface 66 and the top surface. For example, arcuate surface may be a conical surface or a spherical surface that intersects the top surface of the body of the ball marker.

Figure 5C:
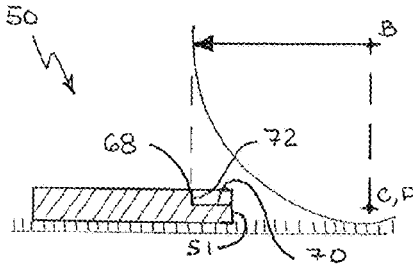

In another embodiment, an arcuate ball location reference 68 is an arcuate edge formed by a shoulder 72 between the top surface and a recessed reference surface 70, as shown in FIG. 5C. As shown the recessed reference surface 70 intersects a side wall of the body, however, it should be appreciated that alternatively the recessed surface may form a cavity in the top surface of the body, which may be paint filled for contrast with the remainder of the body and/or the ball.

Figure 6:
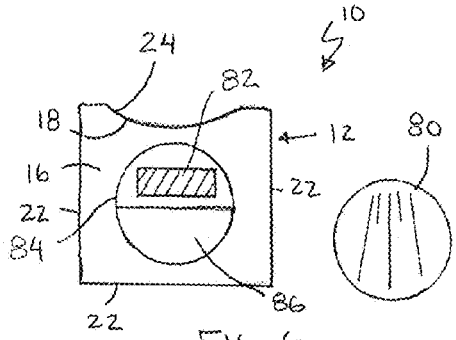
FIG. 6 is a bottom view of a golf ball marker that includes a secondary ball marker.

It should be appreciated that any of the surfaces of the ball marker may be painted, chemically treated, textured, or constructed using multiple materials to increase contrast between portions of the body and/or between the body and an adjacent golf ball. Additionally, alignment indicia may be provided on both the top and bottom surfaces of the marker if desired. Different markings may be provided on the top and bottom surfaces so that the user may easily distinguish As an additional feature, ball marker 10 may provide a holder for a smaller secondary ball marker 80, as shown in FIG. 6. For example, secondary ball marker 80 may be constructed of a ferromagnetic material and a magnet 82 may be integrated into body 12 so that ball marker 80 may be easily, and removably, coupled to body 12. Additionally, a recess 84 that extends into body 12 from bottom surface 16 and sized and shaped to receive ball marker 80 may be provided so that ball marker 80 is flush with bottom surface 16 when received therein. As a further alternative, a second recess 86 may be provided within recess 84 so that ball marker 80 may be easily disengaged from magnet 82 by pressing the portion of ball marker 80 adjacent second recess 86.

Figure 7:
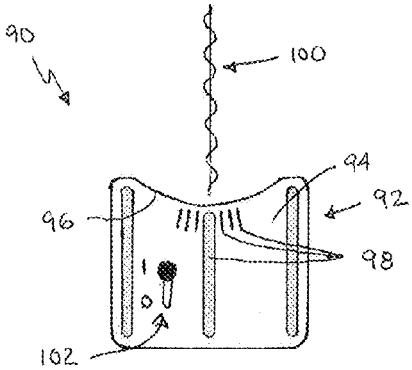
FIG. 7 is a top view of another embodiment of a golf ball marker of the present invention.

The ball marker may also include a focused light source so that the marker may be used as a training aid, as shown in FIG. 7. Ball marker 90, generally includes a body 92 that includes a top surface 94, a ball location reference 96, a plurality of alignment indicia 98 and a focused light source that emits a focused beam of light 100. For example, the light source may be a laser sight, or pointer, so that the alignment of the marker may be easily viewed. Electronics used in the light source may be housed within body 92 and a switch 102 may be accessible on any surface of body 92 so a user may easily turn the light source on and off. In the present embodiment, switch 102 is accessible on top surface 94 and is configured to be slid between an on position and an off position. During use, a user can align marker 90 in an initial orientation, such as toward a hole or practice cup, and use the light beam 100 to determine whether the initial placement of marker 90 actually corresponds to the desired alignment. Any number of light sources may be integrated into ball marker 90 and in embodiments including a plurality of light sources, they may be oriented so that the light beams are parallel. Alternatively the light beams may be angled relative to eachother, such as in alignment with a plurality of alignment indicia 98.

Figure 8:
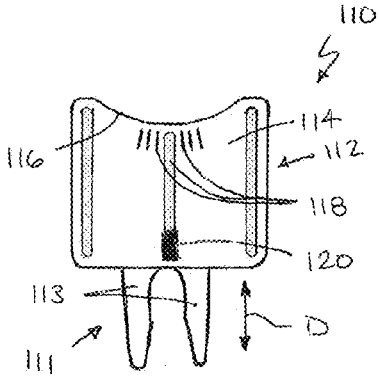
FIG. 8 is a top view of another embodiment of a golf ball marker of the present invention.

As shown in FIG. 8, a ball marker 110 may include an integrated divot tool 111. Generally, ball marker 110 includes a body 112 that includes a top surface 114, a ball location reference 116, a plurality of alignment indicia 118 and divot tool 111. Divot tool 111 includes a pair of prongs 113 that extend beyond the outer perimeter of body 112. In the present embodiment, divot tool 111 is slidably received in body 112 so that prongs 113 may be selectively extended from body 112 by the user. A slide 120 is provided on one of the surfaces of body 112, such as top surface 114, so that divot tool 111 may be extended and retracted in the direction D by a user. The length of prongs 113 is selected so that when divot tool 111 is retracted it is entirely housed within body 112. Additionally, slide 120 is preferably sized and shaped so that it slides within a central alignment indicia so that a user is not distracted during alignment of the ball marker. Alternatively, the divot tool may be non-retractable, such as by including prongs permanently extending from a side wall of the body of the ball marker. As a further alternative, the divot tool may be removable from ball marker 110.

While it is apparent that the illustrative embodiments of the invention disclosed herein fulfill the objectives stated above, it is appreciated that numerous modifications and other embodiments may be devised by those skilled in the art. Elements from one embodiment can be incorporated into other embodiments. Therefore, it will be understood that the appended claims are intended to cover all such modifications and embodiments, which would come within the spirit and scope of the present invention.

I claim:

1. A ball marker, comprising:

a body having a generally geometric perimeter shape and a top surface;

an arcuate ball location reference adjacent the top surface;

at least one elongate alignment indicium disposed on the top surface and generally perpendicular to the arcuate ball location reference; and additional linear alignment indicia disposed on the top surface, wherein the additional alignment indicia are identical and rotated relative to the next adjacent indicium by a constant angle about a focal point spaced from the ball location reference, wherein the ball location reference is interposed between the indicia and the focal point, and wherein the additional linear alignment indicia are symmetric about the elongate alignment indicium in both shape and location.

2. The ball marker of claim 1, wherein the body includes at least one concave arcuate surface intersecting the top surface and the arcuate ball location reference is an arcuate edge formed by the intersection of the top surface and the at least one concave arcuate surface.

3. The ball marker of claim 2, wherein the concave arcuate surface has a radius of curvature in the range of 0.725 inch to 0.975 inch.

4. The ball marker of claim 1, wherein each of the additional alignment indicia is generally perpendicular to the arcuate ball location reference.

5. The ball marker of claim 4, wherein the alignment indicia include at least three indicia.

6. The ball marker of claim 1, wherein the geometric perimeter shape is one of a square, a rectangle and a triangle.

7. The ball marker of claim 1, wherein the geometric perimeter shape is curved.

8. The ball marker of claim 1, further comprising a focused light source coupled to the body.

9. The ball marker of claim 1, further comprising a divot tool coupled to the body.

10. The ball marker of claim 1, wherein the additional linear alignment indicia consist of linear segments and each segment is perpendicular to the arcuate ball location reference.

* * * * *